United States Patent [19]

Masumoto et al.

[11] Patent Number: 4,911,767

[45] Date of Patent: Mar. 27, 1990

[54] CORROSION-RESISTANT ALUMINUM-BASED ALLOYS

[75] Inventors: Tsuyoshi Masumoto; Akihisa Inoue, both of Sendai; Katsumasa Odera, Kurobe, all of Japan

[73] Assignee: Yoshida Kogyo K. K., Tokyo, Japan

[21] Appl. No.: 324,467

[22] Filed: Mar. 16, 1989

[30] Foreign Application Priority Data

Mar. 17, 1988 [JP] Japan ..... 63-61877

[51] Int. Cl.[4] ..... C22C 21/00

[52] U.S. Cl. ..... 148/403; 420/538

[58] Field of Search ..... 148/403, 415, 437; 420/528

[56] References Cited

U.S. PATENT DOCUMENTS 4,710,246 12/1987 Le Caer et al. ..... 148/403

*Primary Examiner*—R. Dean

*Attorney, Agent, or Firm*—Hill, Van Santen, Steadman & Simpson

[57] ABSTRACT

The present invention provides high corrosion-resistant aluminum-based alloys having a composition represented by the general formula $Al_xM_y$ (wherein: M is one metal element selected from the group consisting of Y, La, Ce, Nd and Sm; and x and y range from 75 to 98 atomic percent and from 2 to 25 atomic percent, respectively), the aluminum-based alloy containing at least 50% by volume of amorphous phase. The aluminum-based alloys are especially useful as high corrosion-resistant, high strength, high heat-resistant materials in various applications and, since they exhibit superplasticity in the vicinity of their crystallization temperature, they can be processed into various bulk materials, for example, by extrusion, press working or hot-forging at the temperatures within the range of the crystallization temperature ±100° C.

1 Claim, 5 Drawing Sheets

CORROSION-RESISTANT ALUMINUM-BASED ALLOYS

BACKGROUND OF THE INVENTION

1. Field of the Invention

The present invention relates to aluminum-based alloys having a desired combination of properties of high corrosion-resistance, high hardness, high wear-resistance and high heat-resistance.

2. Description of the Prior Art

As conventional aluminum-based alloys, there have been known various types of aluminum-based alloys, such as Al-Cu, Al-Si, Al-Mg, Al-Cu-Si, Al-Cu-Mg, Al-Zn-Mg alloys, etc. These aluminum-based alloys have been extensively used in a wide variety of applications, such as structural materials for aircrafts, cars, ships or the like; outer building materials, sash, roof, etc; structural materials for marine apparatuses and nuclear reactors, etc., according to their properties.

In order to obtain high corrosion resistance, the conventional aluminum-based alloys have usually been subjected to special treatments, for example, anodizing treatment or coating treatment with organic or inorganic substances by painting or electrolytic deposition. However, such known treatments may complicate the production procedure of the above mentioned structural materials and result in increased production cost. Further, depending on the shapes, for example, as referred to structural or building materials or piping materials having complicated shapes, it may be impossible or difficult to form corrosion-resistant protective coatings. Therefore, satisfactory corrosion resistance has not been achieved up to now.

Further, the conventional aluminum-based alloys generally have a low hardness and a low heat resistance. Recently, attempts have been made to impart a fine-structure to aluminum-based alloys by rapidly solidifing the alloys and thereby improve the mechanical properties, such as strength, and chemical properties, such as corrosion resistance. However, the rapidly solidified aluminum-based alloys known up to now are still unsatisfactory in strength, corrosion resistance, etc.

SUMMARY OF THE INVENTION

In view of the foregoing, it is an object of the present invention to provide novel aluminum-based alloys having an advantageous combination properties of high corrosion-resistance, high strength and superior heat-resistance at relatively low cost.

Another object of the present invention is to provide aluminum-based alloy materials having high corrosion resistance characteristics, without requiring any special treatment, such as anodizing treatment or coating treatment with organic or inorganic substances, for imparting corrosion resistance.

A further object of the present invention is to provide aluminum-based alloy materials which have high hardness and wear-resistance properties and which can be subjected to extrusion, press working, a large degree of bending, etc.

According to the present invention, there are provided aluminum-based alloys having high corrosion-resistance, high strength and heat resistance, the aluminum-based alloys having a composition represented by the general formula:

$$Al_xM_y$$

wherein:

M is a metal element selected from the group consisting of Y, La, Ce, Nd and Sm; and x and y are atomic percentages falling within the following ranges:

$$75 \leqq x \leqq 98 \text{ and } 2 \leqq y \leqq 25,$$

the aluminum-based alloys containing at least 50% by volume of amorphous phase.

The aluminum-based alloys of the present invention are useful as high corrosion resistant materials, high hardness materials and high strength materials. Further, since the aluminum-based alloys exhibit superplasticity in the vicinity of their crystallization temperature, they can be successfully processed by extrusion, press working or the like. The processed articles are useful as corrosion-resistant, high strength, high heat resistant materials in many practical application because of their high corrosion-resistance, high hardness and high tensile strength properties. The aluminum-based alloys are made useful as corrosion-resistant coating materials for various kinds of structural components by sputtering process.

DETAILED DESCRIPTION OF THE PREFERRED EMBODIMENTS

Figure 1:
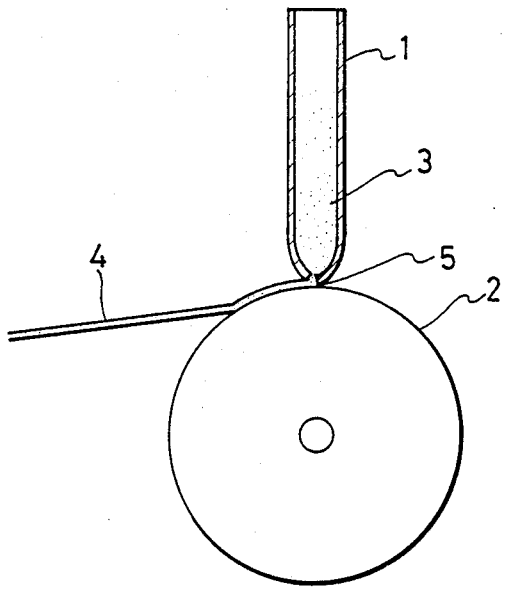
FIG. 1 is a schematic illustration of a single roller-melting apparatus employed to prepare thin ribbons from the alloys of the present invention by a rapid solidification process.

The aluminum-based alloys of the present invention can be obtained by rapidly solidifying melt of the alloy having the composition as specified above by means of liquid quenching techniques. The liquid quenching technique involve rapidly cooling molten alloy and, particularly, single-roller melt-spinning technique, twin roller melt-spinning technique and in-rotating-water melt-spinning technique are mentioned as especially effective examples of such techniques. In these techniques, the cooling rate of about $10^4$ to $10^6$ K/sec can be obtained. In order to produce thin ribbon materials by the single-roller melt-spinning technique or twin roller melt-spinning technique, the molten alloy is ejected from the opening of a nozzle to a roll of, for example, copper or steel, with a diameter of about 30–300 mm, which is rotating at a constant rate of about 300–10000 rpm. In these techniques, various thin ribbon materials with a width of about 1–300 mm and a thickness of about 5–500 μm can be readily obtained. Alternatively, in order to produce wire materials by the in-rotating-water melt-spinning technique, a jet of the molten alloy is directed, under application of the back pressure of argon gas, through a nozzle into a liquid refrigerant layer with a depth of about 1 to 10 cm which is formed by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the relative velocity of the liquid refrigerant surface is preferably in the range of about 0.7 to 0.9.

Besides the above techniques, the alloy of the present invention can be also obtained in the form of thin film by a sputtering process. Further, rapidly solidified powder of the alloy composition of the present invention can be obtained by various atomizing processes, for example, high pressure gas atomizing process or spray process.

Whether the rapidly solidified aluminum-based alloys thus obtained are amorphous or not can be known by checking the presence of halo patterns characteristic of an amorphous structure using an ordinary X-ray diffraction method. The amorphous structure is converted into a crystalline structure by heating to a certain temperature (called "crystallization temperature") or higher temperatures.

In the aluminum alloys of the present invention represented by the above general formula, x is limited to the range of 75 to 98 atomic % and y is limited to the range of 2 to 25 atomic %. The reason for such limitations is that when x and y stray from the respective ranges, it is difficult to produce an amorphous structure in the resulting alloys and the intended alloys having at least 50 volume % of amorphous phase can not be obtained by industrial rapid cooling techniques using the above-mentioned liquid quenching, etc.

The element M which is selected from the group consisting of Y, La, Ce, Nd and Sm has an effect in improving the ability to produce an amorphous structure and considerably improves the corrosion-resistance. Further, the element M not only provides improvements in hardness and strength, but also increases the crystallization temperature, thereby enhancing the heat resistance. A misch metal may be used in place of the foregoing element M, i.e., Y, La, Ce, Nd and Sm and the same effects can be achieved.

Further, since the aluminum-based alloys of the present invention exhibit superplasticity in the vicinity of their crystallization temperatures (crystallization temperature±100° C.), they can be readily subjected to extrusion, press working, hot forging, etc. Therefore, the aluminum-based alloys of the present invention obtained in the form of thin ribbon, wire, sheet or powder can be successfully processed into bulk materials by way of extrusion, press working, hot-forging, etc., at the temperature within the range of their crystallization temperature±100° C. Further, since the aluminum-based alloys of the present invention have a high degree of toughness, some of them can be bent by 180° without fracture.

Now, the advantageous features of the aluminum-based alloys of the present invention will be described with reference to the following examples.

EXAMPLE 1

Molten alloy 3 having a predetermined composition was prepared using a high-frequency melting furnace and was charged into a quartz tube 1 having a small opening 5 with a diameter of 0.5 mm at the tip thereof, as shown in FIG. 1. After heating and melting the alloy 3, the quartz tube 1 was disposed right above a copper roll 2. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

Figure 2:
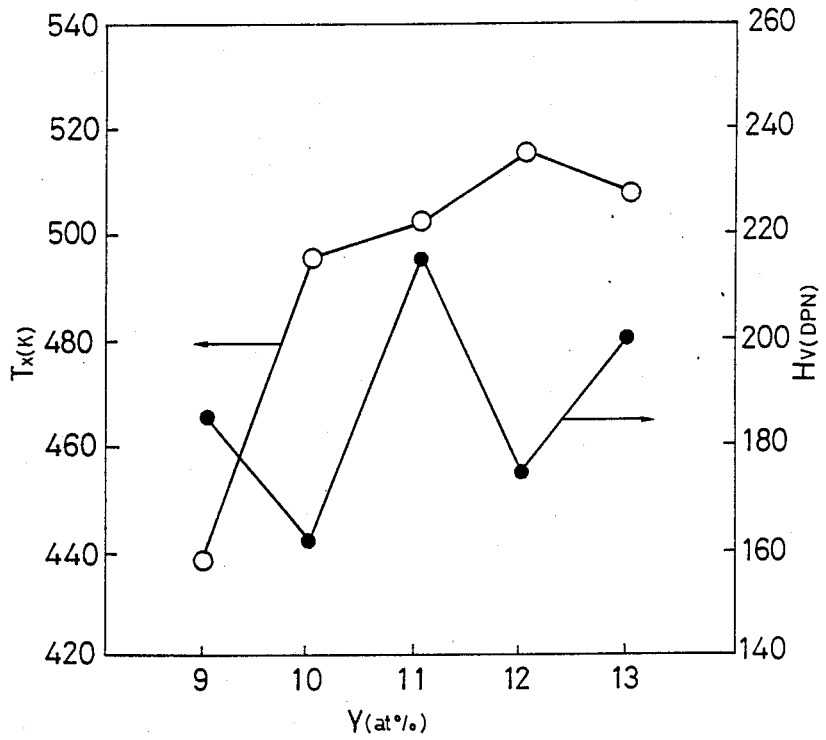
FIGS. 2 to 6 are graphs showing the changes in the crystallization temperature Tx (K) and hardness Hv (DPN) depending on the compositions of the alloy thin ribbons of the present invention.
Figure 3:
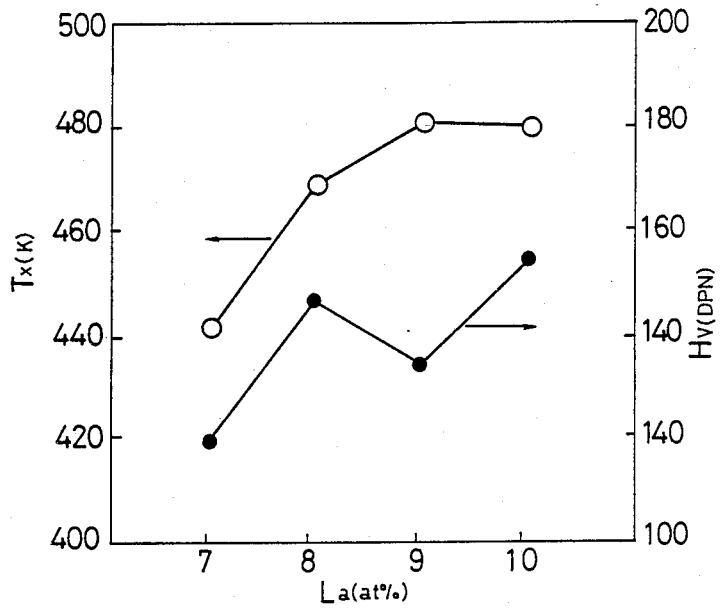
Figure 4:
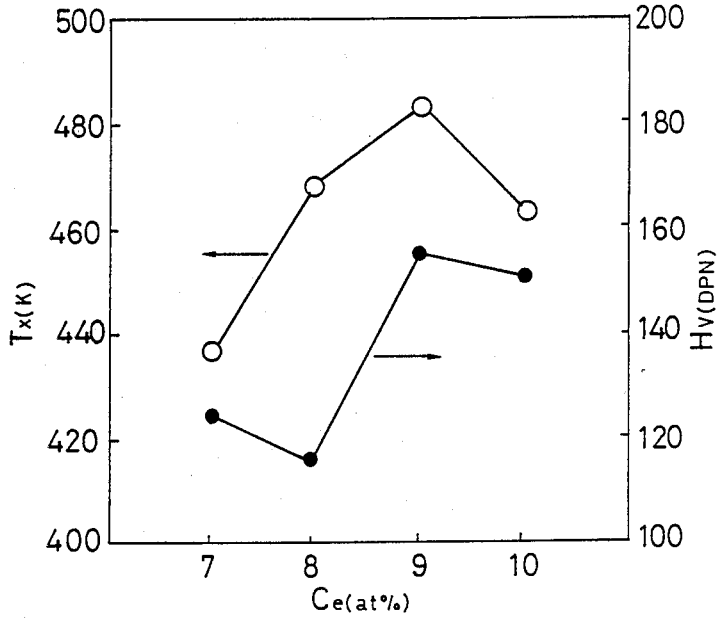
Figure 5:
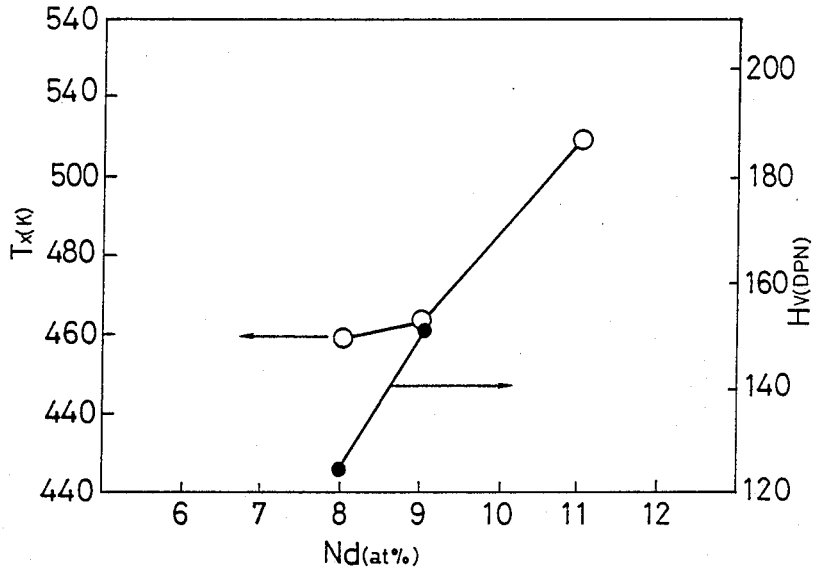
Figure 6:
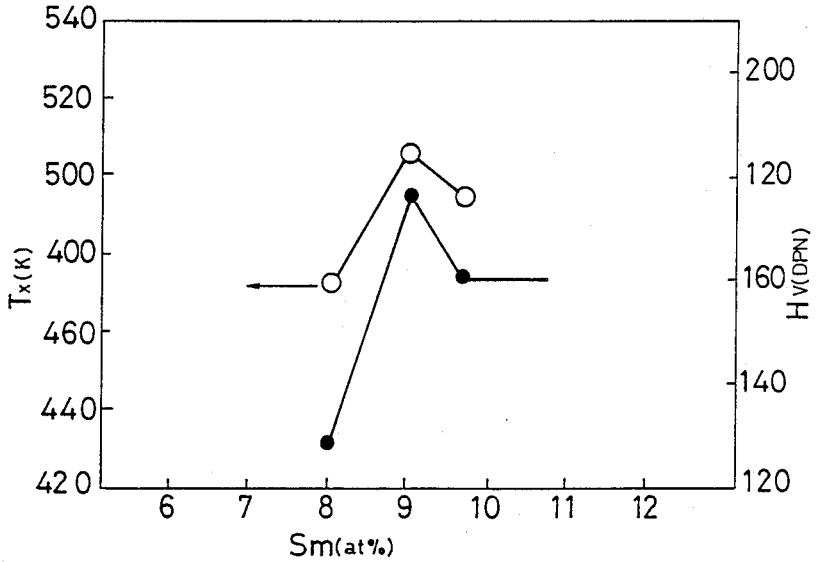

According to the processing conditions as described above, aluminum-based binary alloy thin ribbons of Al-Y, Al-La, Al-Ce, Al-Nd and Al-Sm of the present invention were prepared in the compositions as shown in FIGS. 2 to 6, namely, FIG. 2 for the Al-Y system alloy, FIG. 3 for the Al-La system alloy, FIG. 4 for the Al-Ce system alloy, FIG. 5 for the Al-Nd system alloy and FIG. 6 for the Al-Sm system alloy. The test specimens of the respective thin ribbons were subjected to X-ray diffraction analysis and, as a result, halo patterns characteristic of amorphous structure were confirmed in all of the test specimens. Further, the compositional dependences of the crystallization temperature Tx (K) and hardness Hv (DPN) of the test specimens are shown in FIGS. 2 to 6. The crystallization temperature Tx (K) is the starting temperature (K) of the first exothermic peak on the differential scanning calorimetric curve which was obtained at a heating rate of 40 K/min and the hardness (Hv) is indicated by values (DPN) measured using a micro Vickers hardness tester under load of 25 g.

As shown in the drawings, the aluminum-based alloys of the present invention all have a very high crystallization temperature Tx of 420 to 510 K and exhibit a high hardness of the order of about 120 to 220 DPN. The aluminum alloys have been found to be materials having high corrosion resistance and high hardness.

EXAMPLE 2

Aluminum-based alloy thin ribbons of Al-La system and Al-Ce system were prepared in the same way as described in Example 1 and test specimens having a predetermined length were cut from the alloy thin ribbons. The test specimens were immersed in a hydrochloric acid solution having a given concentration at 50° C. and tested for corrosion resistance to hydrochloric acid. The test results are shown in Table 1. Evaluation of the corrosion resistance was represented by the time required to dissolve the test specimens and a commercial available aluminum foil was used as a reference specimen for this evaluation. As shown in Table 1, most of the thin ribbons required dissolving time of 20 to 30 times that of the commercial available aluminum foil and it is noted that the aluminum-based alloys of the present invention have an excellent corrosion resistance against hydrochloric acid solution as compared with the prior art aluminum-based alloys.

TABLE 1

Results of Corrosion Resistance Test (in 1N—HCl at 50° C.)

| Test Specimen | Thickness (mm) | Dissolving Time |
|---|---|---|
| Al foil | 0.015 | 16 min. |
| $Al_{93}Ce_7$ | 0.016 | 6 hr. and 18 min. |
| $Al_{92}Ce_8$ | 0.018 | 9 hr. and 50 min. |
| $Al_{91}Ce_9$ | 0.018 | 8 hr. and 45 min. |
| $Al_{93}La_7$ | 0.023 | 1 hr. and 9 min. |
| $Al_{92}La_8$ | 0.019 | 4 hr. and 58 min. |
| $Al_{91}La_9$ | 0.017 | 9 hr. and 13 min. |

What is claimed is:

1. A high corrosion-resistant aluminum-based alloy having a composition represented by the general formula:

$$Al_xM_y$$

wherein:

M is one metal element selected from the group consisting of Y, La, Ce, Nd and Sm; and x and y are atomic percentages falling within the following ranges:

$$75 \leqq x \leqq 98 \text{ and } 2 \leqq y \leqq 25,$$

said aluminum-based alloy containing at least 50% by volume of amorphous phase.

* * * * *

UNITED STATES PATENT AND TRADEMARK OFFICE

CERTIFICATE OF CORRECTION

PATENT NO. : 4,911,767

DATED : March 27, 1990

INVENTOR(S) : Tsuyoshi Masumoto, Akihisa Inoue and Katsumasa Odera

It is certified that error appears in the above—identified patent and that said Letters Patent is hereby corrected as shown below:

On the Face of the patent, change the Assignee to read: "Yoshida Kogyo KK, Tokyo, Japan; Tsuyoshi Masumoto, Sendai, Japan" (Part Interest)

Signed and Sealed this

Sixteenth Day of June, 1992

*Attest:*

DOUGLAS B. COMER

*Attesting Officer*

*Acting Commissioner of Patents and Trademarks*